United States Patent [19]

Holtmann

[11] 4,364,341

[45] Dec. 21, 1982

[54] VALVE CONTROL DEVICE FOR AN INTERNAL COMBUSTION ENGINE

[76] Inventor: Teodoro Holtmann, Elfriedenstr. 27, 4300 Essen 1, Fed. Rep. of Germany

[21] Appl. No.: 270,956

[22] Filed: Jun. 8, 1981

[30] Foreign Application Priority Data

Jun. 13, 1980 [DE] Fed. Rep. of Germany ..... 3022188

[51] Int. Cl.[3] ..... F01L 1/34

[52] U.S. Cl. ..... 123/90.17; 123/90.25

[58] Field of Search ..... 123/90.15, 90.17, 90.24, 123/90.25

[56] References Cited

U.S. PATENT DOCUMENTS

| | | | |
|---|---|---|---|
| 1,679,794 | 8/1928 | Smith | 123/90.25 |
| 2,954,017 | 9/1960 | Forstner | 123/90.26 |
| 3,430,614 | 3/1969 | Meacham | 123/90.24 |
| 3,888,216 | 6/1975 | Miokoyic | 123/90.25 |

*Primary Examiner*—William A. Cuchlinski, Jr.
*Attorney, Agent, or Firm*—Martin A. Farber

[57] ABSTRACT

The valve control system for the continuous adjustment of the control times and strokes of the valves of an internal combustion engine has an eccentric shaft which is common to the intake and exhaust valves and is arranged in the cylinder head and which has for each cylinder a single eccentric for the driving of two connecting rods 4. The two connecting rods 4 form between their longitudinal axes an angle of less than 180° and each of them drives a swing cam 6. For the positive control of the intake and exhaust valves respectively each swing cam is in engagement in both directions of swing in form-locked manner with the fork section of a valve rocker which is pivotally connected to the associated valve. The eccentric shaft is displaceable transversely to its longitudinal axis in a direction such that by a displacement of the eccentric shaft the distances between the eccentric and the axes of the two valve rockers are simultaneously decreased and increased respectively.

8 Claims, 6 Drawing Figures

VALVE CONTROL DEVICE FOR AN INTERNAL COMBUSTION ENGINE

The present invention relates to a valve control or timing device for an internal combustion engine, particularly a high speed motor vehicle engine, for the continuous adjustment of the control times and strokes of the intake and exhaust valves corresponding to the speed of rotation and/or load of the engine.

As is known, the power characteristic of a piston combustion engine is determined substantially by the valve control times and strokes and the control cross sections resulting therefrom. In the traditional camshaft valve gears these can be designed for favorable values of torque, consumption and exhaust composition only for a relatively narrow range of speeds of rotation, which results, particularly in automobile engines which must have the widest possible useful range of speeds, in a considerable impairment of the efficiency both in the lower speed range and in the upper speed range. Numerous valve control arrangements have already been proposed in order to eliminate this defect, for instance in West German OS No. 20 06 618, OS No. 23 63 819 and OS No. 26 29 554. However, up to now they have not achieved standard use in automotive engines. This is probably due primarily to the fact that the adjustable valve control devices known up to the present time are in most cases considerably more complicated and expensive to manufacture than ordinary camshaft valve gears in addition to which in most cases there has also been a considerable manufacturing expense due to complicated hydraulic, pneumatic or electric control devices, and to the fact that the results obtained with the adjustable valve gears known up to now have not been sufficiently optimal and satisfactory to make this additional expense appear worthwhile for standard use.

The object of the present invention is to provide a valve control device which is adjustable in accordance with speed of rotation and/or load, in which on the one hand the unavoidable additional expense as compared with the traditional camshaft valve gear is maintained within reasonable limits and which, on the other hand, while being of simple development from a manufacturing and functional standpoint, permits optimal variations of the control times and strokes of the valves and makes it possible to achieve the desirable goal that the opening and closing times of exhaust valve and intake valve in front of and behind the dead centers of the engine crankshaft change upon a displacement by unequal crank angles and at the upper dead center of the crankshaft overlap to different extents at low and high speed of rotation of the engine, and that upon change of the valve control times and strokes from a maximum at high speed of rotation of the engine to a minimum at idling speed the intake-valve stroke is more reduced than the stroke of the exhaust valve, which may be desirable in order to increase the intake flow velocity in the lower speed range by the greater reduction in the opening cross section of the intake valve, as a result of which the turbulence in the cylinder is improved.

This object is achieved in accordance with the invention primarily by the development of the valve control device in such a manner that the eccentric shaft (1) receives jointly on only one eccentric (2) per cylinder both connecting rods (4) for the intake valve (21) and the exhaust valve (22) of that cylinder, that each connecting rod (4) is coupled with a double-acting swing cam (6) which, for the positive control of the valve in both directions of swing is in form-locked engagement with a fork-shaped section of a valve rocker (12) pivoted to the valve, that the two connecting rods (4) form an angle of less than 180° between their longitudinal axes which extend through the center point of the eccentric and the pivot point of the connecting rods to the swing cams and that the eccentric shaft (1) is displaceable transversely to its longitudinal axis in such a manner that the distances between the eccentric shaft and the axes (11) of the two swing cams (6) are simultaneously reduced or increased upon a change in the position of the eccentric shaft.

By the use of a single eccentric with continuous peripheral surface for both connecting rods which drive the valves of a cylinder, the intermediate pins lying between the eccentric and the adjacent pivot pins of the eccentric shaft are at least as long as a connecting rod is wide so that therefore there can be used simple unsplit connecting rods, i.e. rods which are closed as a single part at their bearing lug which surrounds the eccentric, which connecting rods can be pushed axially one after the other onto the eccentric shaft and its eccentric. In the same way single-piece eccentric-shaft bearings can also be employed and pushed one after the other axially onto the eccentric shaft. If the two connecting rods received by a common eccentric form an angle between their longitudinal axes of less than 180°, the intake valve and the exhaust valve of a cylinder can be actuated simultaneously with control angles which are suitable for practical use by a single eccentric shaft and a single eccentric, and the transmission of the reciprocating motion of the connecting rods first of all to swing cams which in their turn drive valve rockers acting on the valves by simple positional arrangement of the eccentric shaft with respect to the swing cam axes and positional arrangement of the valve-rocker axes with respect to the swing cam axes, valves arranged both in a V and in a line can be actuated. The cooperation of the swing cams with the valve rockers in form-locked manner in both directions of swing whereby the valves are opened and closed in positive fashion avoids the use of valve springs and thereby frees all movable parts from high spring forces, so that the moving parts can be dimensioned considerably smaller and lighter. The arrangement of the connecting rods with an included angle between the longitudinal axes of the connecting rods of less than 180° makes it possible, by the displacement in accordance with the invention of solely the eccentric shaft to change the control times simultaneously at the intake valve and the exhaust valve and to change the stroke continuously between a maximum and a minimum. In this connection the direction of the displacement of the eccentric shaft can be so selected and dimensioned that the most favorable changes in the control times and strokes desired in each case for the intake valve and the exhaust valve occur upon the displacement of the eccentric shaft. If, for instance, the direction of displacement is such that upon the displacement of the eccentric shaft the distances between the eccentric shaft and the axes of the two valve rockers for the intake valve and the exhaust valve change uniformly, the control angles and displacements of intake valve and exhaust valve will in principle be changed by the same amounts. The direction of displacement of the eccentric shaft is preferably such that upon displacement of the eccentric shaft the distance between the eccentric shaft and the swing cam for the exhaust valve changes slightly less than the distance between the eccentric shaft and the swing cam for the intake valve in order thereby to obtain the result that upon a displacement of the eccentric shaft the control times and the stroke of the intake valve change more than in the case of the exhaust valve. Upon the displacement of the valve control from a maximum to a minimum there then takes place a stronger reduction of the stroke of the intake valve, which is favorable for operation of the engine in the lower speed range. It is also possible to have the direction of displacement of the eccentric shaft extend in such a manner that upon the displacement of the eccentric shaft there takes place for all practical purposes only a change in the control times and of the stroke of the intake valve. With positive control of the valves the eccentric shaft, due to the absence of spring forces and the low inertia forces of the light moving parts, can be displaced with relatively little force so that the displacement of the eccentric shaft can be effected purely manually or coupled with the gas pedal, which furthers the desired simplicity of the adjustment of the valve control arrangement.

The manner of operation as well as other advantageous features of the valve control arrangement of the invention will be described below with reference to the drawing in which various illustrative embodiments are shown and in which.

In both embodiments the same reference numbers have been used for identical or similar parts while for other parts which correspond to each other but differ in their shape reference numbers differing from each other by a superscript are used.

Figure 1:
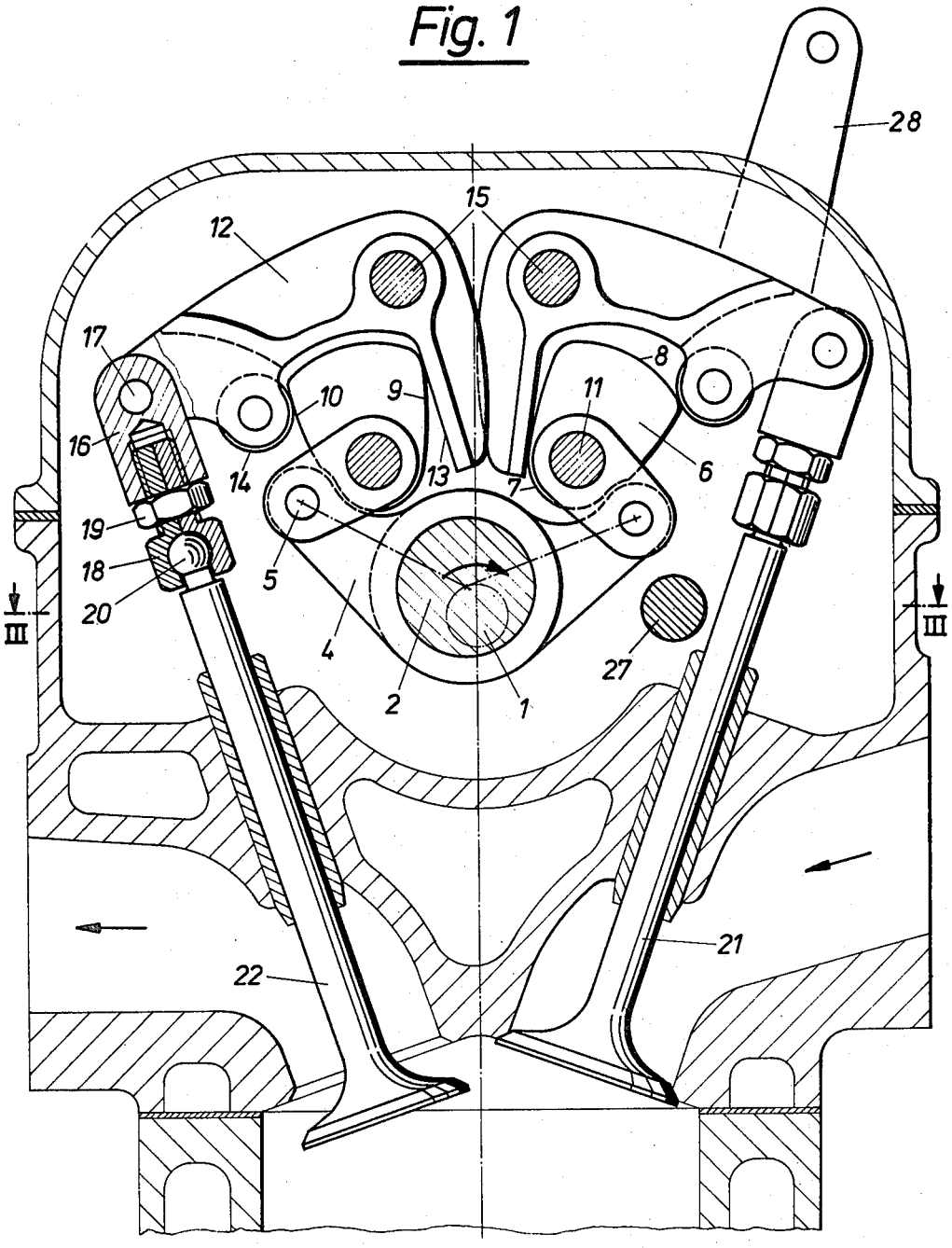
FIG. 1 is a cross section along the line I—I of FIG. 3 through the cylinder head of a four-stroke internal combustion engine with valves arranged in V shape.
Figure 2:
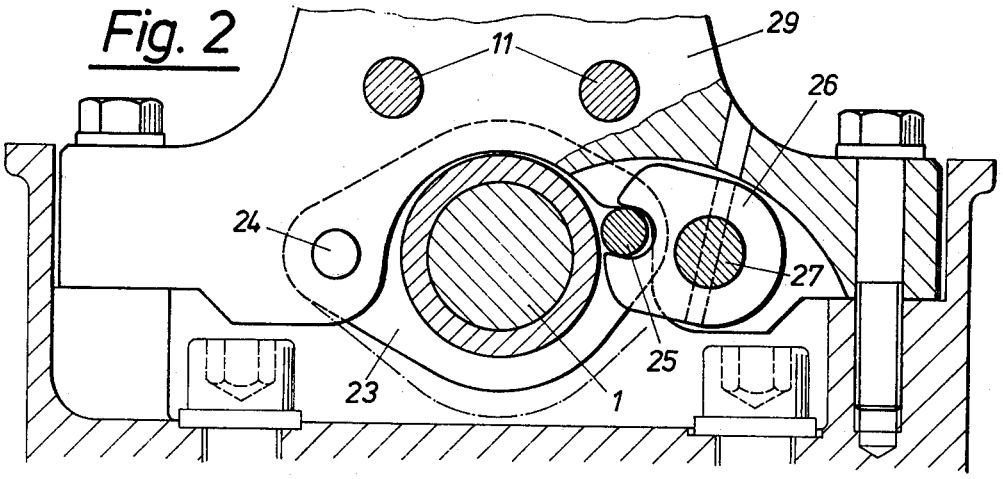
FIG. 2 is a cross section along the line II—II of FIG. 3 extending through an eccentric shaft bearing.
Figure 3:
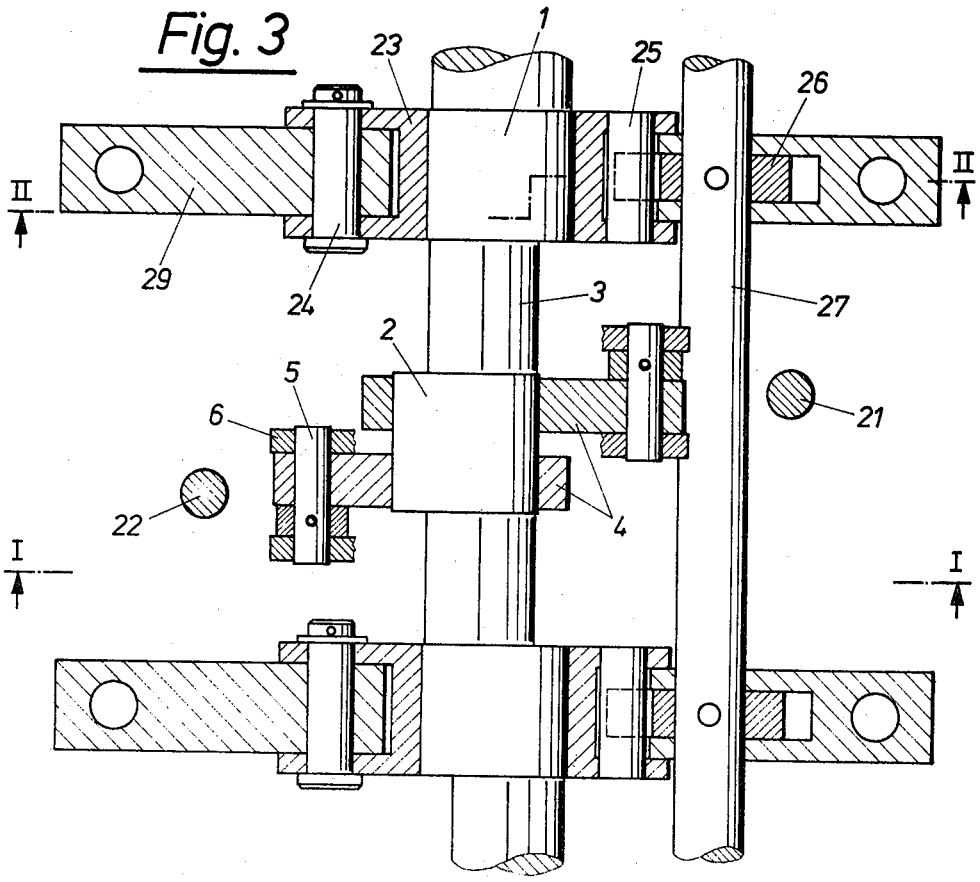
FIG. 3 is a longitudinal section along the line III—III in FIG. 1 extending through the plane of the eccentric shaft.

In the embodiment shown in FIGS. 1 to 3, the V-shaped valve arrangement leaves sufficient room to arrange the eccentric shaft 1 symmetrically between the two rows of valves and to displace it essentially in the longitudinal axis of the cylinders. In order to control the pair of valves of each cylinder, the eccentric shaft 1 has only a single eccentric 2 which receives on its circumference two connecting rods 4 for the joint control of the intake valve 21 and the exhaust valve 22. Each connecting rod 4 is pivoted via a joint 5 to a swing cam 6 the axis 11 of which is so arranged that the longitudinal axes of the two connecting rods 4 which extend between the center of the eccentric and the joints 5 form with each other an angle of less than 180° and therefore in the embodiment shown form an angle of less than 90° with the vertical longitudinal axis of the cylinders. Each swing cam 6 is in engagement with a valve rocker 12 mounted on a shaft 15. The one valve rocker 12 is articulated to the intake valve 21 and the other valve rocker 12 to the exhaust valve 22. The swing cams 6 and the valve rockers 12 are shaped for positive control of the valves. Each swing cam 6 has two circular sections 7 and 8 concentric to the axis 11. The smaller section 7 passes into the valve opening curve 9 of the swing cam 6 while the larger section 8 passes into its valve closing curve 10. For form-locked cooperation with the swing cam 6 in both directions of swing, the valve rocker 12 on the one side of the swing cam 6 has a surface 13 and on the other side of the swing cam 6 a roller 14. By this development of the valve rocker with a control surface for the opening and a roller for the closing of the valve, there is obtained for the same valve stroke a considerably smaller angle of rotation of the swing cam than in the known positive controls whose valve rockers rest via two control surfaces against an oscillating cam. This makes possible an eccentric shaft having a comparatively small stroke, which in its turn permits small eccentric and pivot pins, while retaining sufficiently strong intermediate pins.

When the valve is closed, the surface 13 of the valve rocker 12 rests on the circular section 7 of the swinging swing cam 6 while at the same time the roller 14 of the valve rocker 12 rolls on the circular section 8 of the swing cam 6, as a result of which the valve rocker 12 is blocked against swinging. For the opening, for instance, of the exhaust valve 22, the left swing cam 6 in FIG. 1 swings in clockwise direction, as a result of which the valve opening curve 9 presses against the surface 13 of the valve rocker 12, the roller 14 at the same time rolling from the section 8 onto the valve closure curve 10 of the swing cam 6. For the closing of the exhaust valve 22, the swing cam 6 swings in counterclockwise direction whereby the valve closure curve 10 presses against the roller 14 and the surface 13 of the valve rocker 12 follows the receding valve opening curve 9.

The joint connecting the valve rocker 12 to the valve consists of a joint head 16 which is pivoted by a joint 17 to the valve rocker 12. A connecting piece 18 is screwed into the joint head 16, said piece being divided lengthwise into two halves and being secured by a lock nut 19 against turning in the joint head 16. The two halves of the connecting piece 18 form a spherical cup which receives a spherical head 20 of the valve. This articulated connection permits free rotation of the valve with respect to the valve rocker and simple adjustment of the valve in such a manner that upon contact of the roller 14 with the section 8 and of the surface 13 with the section 7, the valve is in the closed position. The closed position of the valves does not change when, as will still be described, the valve control device of the invention is displaced in order to change the valve control times and valve strokes. In order that the valves sit tightly on their valve seats in their closed position, the articulated connection can be developed, for example, with a small clearance in the direction of the valve stroke so that the valve can be pressed tightly against the valve seat, in the position withdrawn by the valve rocker, by the gas pressure in the cylinder or, for instance, an intermediate element having spring elasticity in the valve closing direction can be installed in the articulated connection so that when the valve comes onto the valve seat the valve rocker can still carry out a swinging movement in the closing direction.

For the displacement of the eccentric shaft 1 in a direction which is substantially parallel to the vertical cylinder longitudinal axis and in which the distances between the eccentric shaft 1 and the swing cam axes 11 change simultaneously approximately uniformly, the eccentric shaft is supported in bearing members 23 which are swingable in lever-like manner and the swivel axis 24 of which lies laterally alongside the bearing lug of the bearing bodies 23 for the eccentric shaft so that the lever longitudinal axis of the bearing bodies 23 forms an angle of substantially 90° with the cylinder longitudinal axis. The bearing bodies 23 are pivoted to bearing supports 29 which serve at the same time to receive the shafts of the swing cams 6 and the shafts 15 of the valve rockers 12. In the bearing supports 29 there is furthermore supported an adjustment shaft 27 which bears an adjustment lever 28 and to which claws 26 are fastened secured against twisting. The claws 26 are in engagement with pins 25 on the free lever end of the bearing bodies 23. By means of the lever 28 the adjustment shaft 27 can be turned by a given angle in both directions, as a result of which the bearing bodies 23 are swung via the claws 26 and the eccentric shaft 1 is thus displaced upward or downward. In this way the adjustment of the valve control times and valve strokes is effected. When the eccentric shaft 1 is displaced in the direction towards the swing cams 6, i.e. upward in FIG. 1, the control angle and the strokes of both valves are increased. By displacement of the eccentric shaft 1 in FIG. 1 in downward direction, the distance between the eccentric shaft and the swing cam axes 11 increases and in this way the control angles and strokes of the valves are reduced. An undesired, excessive reduction of the exhaust-valve stroke is avoided in the manner that the swivel axes 24 of the bearing bodies 23 lie on the same side, laterally alongside of the vertical cylinder axis, as the exhaust valve 22 and their swing cam 6 and that the eccentric shaft 1 upon its displacement describes a circular arc around the swivel axes 24 so that upon the lowering the eccentric shaft 1 moves somewhat further away from the intake valve swing cam than from the exhaust valve swing cam.

Figure 4:
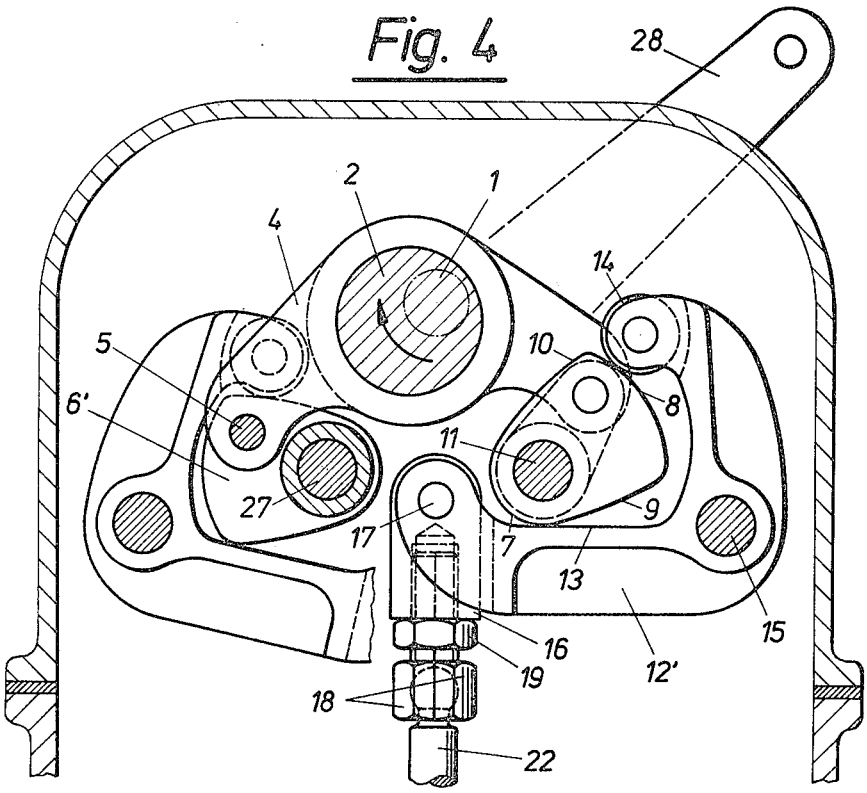
FIG. 4 is a cross section similar to FIG. 1 through another embodiment with valves arranged in line.

FIG. 4 shows an embodiment for in-line valves which operates in accordance with the same principle as the embodiment of FIGS. 1 to 3. In the embodiment of FIG. 4, the eccentric shaft 1 lies centrally above the row of valves; to the left alongside of the vertical cylinder axis there are the swing cam 6' and the valve rocker 12' for the intake valve (not shown in detail) and on the right alongside of the vertical cylinder axis there are the swing cam 6' and the valve rocker 12' for the exhaust valve 22. With the in-line arrangement of the valves, the valve rockers 12' engage from below in fork-like manner around the swing cams 6' while in the case of the V arrangement of the valves the valve rockers 12 engage in fork like manner from above around the swing cams 6. The change in the valve control times and valve strokes by displacement of the eccentric shaft (increase or reduction of the distance of the eccentric shaft from the swing cams lying below the eccentric shaft) otherwise corresponds to the described function of the embodiment of FIGS. 1 to 3.

Figure 5:
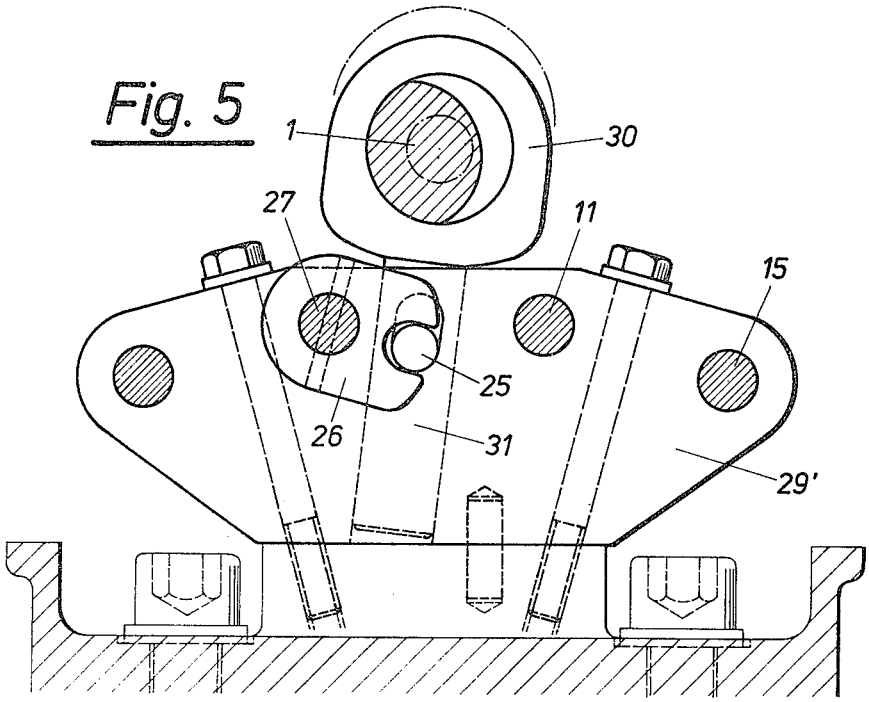
FIG. 5 is a cross section similar to FIG. 2 through another embodiment of the eccentric shaft bearing.

FIG. 5 shows an embodiment of the eccentric shaft support for a linear displacement which is structurally adapted for the embodiment shown in FIG. 4 with in-line valves. The eccentric shaft 1 is supported in bearing bodies 30 which are guided by shanks 31 in linearly displaceable manner in the bearing supports 29'. On the shanks 31 there are arranged the pins 25 on which the claws 26 of the adjustment shaft 27 act. This development of the eccentric-shaft mounting has the advantage that one of the swing cam shafts 11 or one of the valve rocker shafts 15 can be used as an adjustment shaft and a separate additional adjustment shaft 27 can thereby be dispensed with. In FIG. 5 the shanks 31 are somewhat inclined in such a manner that in this case also the displacement of the eccentric shaft has a direction such that the distance between the eccentric shaft and the axis of the valve rocker for the exhaust valve changes less, by a displacement of the eccentric shaft, than the distance between the eccentric shaft and the axis of the valve rocker for the intake valve. In this way a greater change in the control times and in particular of the stroke of the intake valve than of the exhaust valve is also obtained by displacement of the eccentric shaft.

Figure 6:
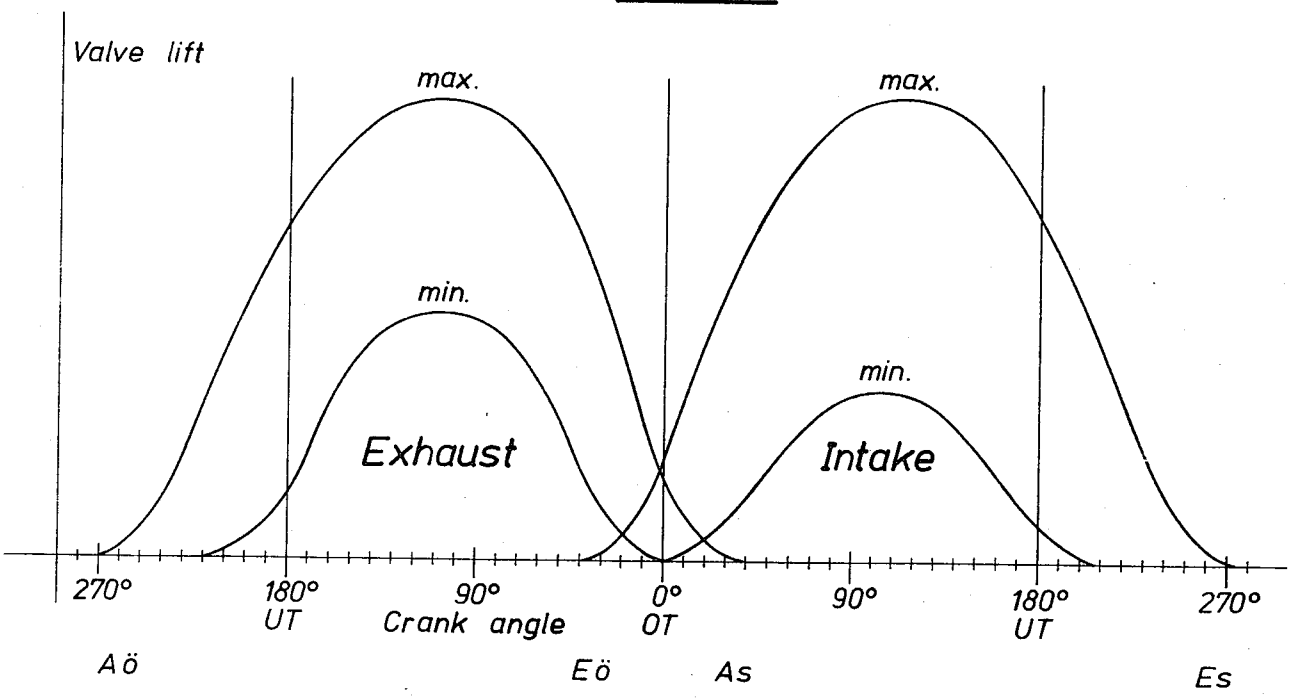
FIG. 6 is a timing diagram to show the adjustment ranges with the corresponding minimum and maximum value lift curves.

The control diagram (timing diagram) shown diagrammatically in FIG. 6 shows the adjustment ranges of the control angles and of the valve strokes on basis of two valve lift curves plotted one above the other, they resulting from in each case the minimum and maximum end positions of the eccentric shaft 1. The abbreviations used in FIG. 6 have the following meaning:

OT=upper dead center of the engine crankshaft
UT=lower dead center of the engine crankshaft
Eö=intake valve opens
Es=intake valve closes
Aö=exhaust valve opens
As=exhaust valve closes.

The crank angles plotted are referred to the engine crankshaft which in the case of a four-stroke internal combustion engine rotates twice as fast as the eccentric shaft. With respect to the control angles of the valves, in the case of most four-stroke internal combustion engines the control angles "exhaust valve opens before upper dead center" and "intake valve closes after lower dead center" are substantially larger than the control angles "exhaust valve closes after upper dead center" and "intake valve opens before upper dead center" respectively, generally by about two to three times. If large adjustment ranges suitable for practice are now desired, the control angles "exhaust valve opens before lower dead center" and "intake valve opens after lower dead center" must, upon change of the valve control from the maximum curve towards the minimum curve be reduced considerably more than the control angles "exhaust valve closes after upper dead center" and "intake valve opens before upper dead center." This furthermore can be realized to the required extent with the valve control arrangement of the invention. As shown in FIG. 6 and as has also been determined in practical tests, the development of the valve control means in accordance with the invention has the result that, for instance, at the intake valve, when the time of opening changes by 40 crank degrees by adjustment of the eccentric shaft 1, the closing time changes by 60 crank degrees, and at the same time the stroke of the intake valve, starting from a constant dead center in the valve-closed position, is changed between a maximum and a minimum of, for instance, one-third of the maximum. This is related to the fact that, for instance, in FIG. 1 in the case of the intake valve 21, at each position in height of the eccentric shaft 1 during the closing time of the intake valve 21 the swing cam 6 swings with its circular sections 7 and 8 on the surface 13 and the roller 17 of the valve rocker 12 respectively so that the dead center, in the closed position of the valve, always remains the same and that, for instance, by lifting the eccentric shaft 1 the distance extending obliquely to the approximately vertical direction of displacement present between the eccentric shaft 1 and the swing cam axis 11 is reduced and, via the also obliquely extending connecting rod 4, the swing cam 6 is advanced in counterclockwise direction, as a result of which its valve opening curve 9 commences to press at an earlier moment against the valve rocker 12 and also carries out a larger angle of swing, producing the larger valve stroke. By the variation of the angle of inclination of the connecting rod 4 with respect to the direction of displacement upon the adjustment of the eccentric shaft 1 the result is obtained that the opening time of the intake valve in front of upper dead center changes to a different extent than the closing time of the intake valve after lower dead center. The same applies to the exhaust valve 22, in connection with which, however, a smaller change in stroke can be effected if the direction of displacement of the eccentric shaft extends in such a way in the manner described that the distance from the eccentric shaft to the exhaust valve swing cam changes less than the distance to the intake valve swing cam.

Within the scope of the development of the valve control device in accordance with the invention it is also possible to have the swing cams and valve rockers cooperate only in the direction of the opening of the valves and to close the valves by means of springs.

I claim:

1. In a valve control system in cylinders of an internal combustion engine, particularly for high-speed automotive engines, for the continuous adjustment of valve control times and valve strokes in accordance with the speed of rotation and/or load of the engine, having an eccentric shaft arranged in a cylinder head of the engine common to intake and exhaust valves, to which shaft there are pivoted connected rods which point in opposite directions transverse to the longitudinal axis of the eccentric shaft and which operatively drive valve rockers acting on the intake and exhaust valves, the improvement comprising a pair of said intake and exhaust valves per cylinder, said eccentric shaft has only one eccentric thereon per cylinder, two of said connecting rods for operatively driving said intake valve and the exhaust valve of said cylinder respectively are jointly mounted on said one eccentric, a double-acting swing cam means is operatively pivotally coupled to each said connecting rod, respectively, each said swing cam means being for positive control of the valve associated therewith in both directions of swing thereof via respective of the valve rockers, each of the valve rockers being formed with a fork-shaped section in form-locked engagement with an associated of said swing cam means, each said valve rockers being operatively pivoted to the associated valve, respectively, said two connecting rods form an angle of less than 180 degrees between longitudinal axes respectively thereof extending through a center point of said eccentric and an operative pivot point of said connecting rods to said swing cam means, respectively, means for displacing the eccentric shaft transversely to the longitudinal axis of said eccentric shaft in such a manner that the distances between said eccentric shaft and pivot axes of said two swing cams are simultaneously changed upon a change in the position of the eccentric shaft.

2. The valve control system according to claim 1, wherein said eccentric shaft by said displacing means is displaceable transversely to its longitudinal axis in such direction that the distance from said eccentric shaft to said pivot axis of said swing cam means associated with said exhaust valve changes less than the distance from the eccentric shaft to said pivot axis of said swing cam means associated with said intake valve.

3. The valve control system according to claim 1, wherein said swing cam means each have a valve opening curve and a valve closing curve, said valve rockers have a straight surface operatively resting against said valve opening curve of said swing cam means and a surface rounded in the manner of a roller operatively cooperating with said valve closing curve of said swing cam means.

4. The valve control system according to claim 3, wherein said surface rounded constitutes a roller mounted on said valve rockers, respectively.

5. The valve control system according to claim 1, further comprising means for the pivoted connection of said valve rockers with said valves, respectively, comprising a joint head is pivotally connected to said valve rocker, a connecting piece is screwed into said joint head and is split in a longitudinal direction into two halves, a nut is lockingly disposed on said connecting piece, said two halves of said connecting piece form a spherical cup, said valve has a spherical head turnably mounted in said spherical cup.

6. The valve control system according to claim 1, further comprising bearing bodies pivotally mounted in lever-like manner and having a lever longitudinal axis extending substantially at right angles to the direction of said displacement of said eccentric shaft, said eccentric shaft is mounted in said bearing bodies, an adjustment shaft having claws connected thereto, said claws engaging said bearing bodies and constituting means for swinging said bearing bodies.

7. The valve control system according to claim 1, further comprising bearing bodies, said eccentric shaft is mounted in said bearing bodies, shank means for guiding said bearing bodies in linearly displaceable manner, pins disposed on said shanks, an adjustment shaft having claws connected thereto, said claws engaging said pins and constituting means for displacing said bearing bodies via said pins and shank means.

8. The valve control system according to claim 1, further comprising a pivot link member constitutes the means for pivotally connecting one of said connecting rods with an associated of said swing cam means via said pivot point and said pivot axis such that said pivot link is connected to said swing cam means via said pivot axis and to said connecting rod via said pivot point.

* * * * *